US010556209B2

(12) United States Patent
Gandhi

(10) Patent No.: US 10,556,209 B2
(45) Date of Patent: Feb. 11, 2020

(54) PROTEIN BLENDER CUP

(71) Applicant: Ashish Gandhi, Buena Park, CA (US)

(72) Inventor: Ashish Gandhi, Buena Park, CA (US)

( * ) Notice: Subject to any disclaimer, the term of this patent is extended or adjusted under 35 U.S.C. 154(b) by 0 days.

(21) Appl. No.: 15/406,765

(22) Filed: Jan. 15, 2017

(65) Prior Publication Data

US 2017/0274332 A1 Sep. 28, 2017

Related U.S. Application Data

(60) Provisional application No. 62/313,794, filed on Mar. 27, 2016.

(51) Int. Cl.

| | |
|---|---|
| ***B01F 7/00*** | (2006.01) |
| ***B01F 15/00*** | (2006.01) |
| ***B01F 7/30*** | (2006.01) |
| ***B01F 3/12*** | (2006.01) |
| ***B01F 7/20*** | (2006.01) |
| ***B01F 7/16*** | (2006.01) |
| ***B01F 13/00*** | (2006.01) |

(52) U.S. Cl.

CPC ..... *B01F 15/00506* (2013.01); *B01F 3/1221* (2013.01); *B01F 7/0015* (2013.01); *B01F 7/00141* (2013.01); *B01F 7/00258* (2013.01); *B01F 7/00583* (2013.01); *B01F 7/00641* (2013.01); *B01F 7/00725* (2013.01); *B01F 7/1695* (2013.01); *B01F 13/0022* (2013.01); *B01F 2215/0022* (2013.01)

(58) Field of Classification Search

CPC .. A47J 43/1025; A47J 43/082; A47J 43/1031; A47J 43/0705; A47J 43/08; A47J 43/085; B01F 15/00506; B01F 2215/0022; B01F 13/002

See application file for complete search history.

(56) References Cited

U.S. PATENT DOCUMENTS 4,854,718 A * 8/1989 Wang ..... A47J 43/0711 366/252
4,959,517 A * 9/1990 Jump ..... A47J 36/027 219/726
6,702,455 B2 * 3/2004 Vendrely ..... B01F 13/002 366/130
7,278,778 B2 * 10/2007 Sand ..... B01F 7/0005 366/139

(Continued)

*Primary Examiner* — Tony G Soohoo
*Assistant Examiner* — Elizabeth Insler
(74) *Attorney, Agent, or Firm* — Patent Law Agency, LLC; Peter Ganjian

(57) ABSTRACT

Present invention creatively makes convenient for any person using beverage to blend powder with liquid uniformly without use of shaking motion or battery and thereby preventing from spilling and running out batteries. Invention of unique reverse planetary gears system and side arm stirrer with window paddle has made possible convert torque of finger to multiple rotation of stirrer in order achieve efficient uniform blending. Moreover, this invention takes full advantage of removable snap mechanism to assemble and disassemble protein blender cup which is very necessary for washing every single parts to achieve highest sanitization. In short, this invention helps consumer to have protein blender cup which doesn't require shaking or battery and can be completely sanitized without any struggle.

15 Claims, 12 Drawing Sheets

(56) References Cited

U.S. PATENT DOCUMENTS

| | | | | |
|---|---|---|---|---|
| 8,136,978 | B2 * | 3/2012 | George | A47J 43/1025<br>366/130 |
| 8,695,490 | B2 * | 4/2014 | Harris | A47J 43/1031<br>99/537 |
| 8,708,262 | B2 * | 4/2014 | Wong | A47J 43/1025<br>241/169.1 |
| 9,370,278 | B1 * | 6/2016 | Suquet | A47J 43/24 |
| 2004/0159727 | A1 * | 8/2004 | Mueller | A47J 43/1025<br>241/169.1 |

* cited by examiner

| | |
|---|---|
| 1 | Cup Body |
| 2 | Stirrer |
| 3 | BottomCap |
| 4 | Planetary Gears |
| 5 | Sun Gear |
| 6 | Ring gear |
| 7 | Top Cap |
| 8 | Snap Shaft Cap |
| 9 | Spout Cap |

PROTEIN BLENDER CUP

FIELD OF THE INVENTION

The present invention relates generally to a liquid storage receptacle. More specifically, the present invention is a cup with an integrated blender system that is manually operated to blend contents within the cup. The present invention is quickly and conveniently disassembled for cleaning after using through snap mechanism.

BACKGROUND OF THE INVENTION

Nutritional supplements are commonly utilized by people before, during, and after strenuous workouts. Nutritional supplements such, as whey protein, are commonly found in the form of powdered products, which are mixed with liquids to create nutritional beverages. Without proper, stirring, the powder tends to clump together and float in chunks within the liquid. Blender cups that are presently available on the market generally require batteries or manual shaking of the contents, There are several drawbacks to the currently available products. Battery-operated electronic blender cups are expensive and it is often quite difficult to replace the batteries. Blender cups that require manual shaking are subject to the contents within the cups leaking or spilling. The present invention seeks to address the inherent issues found in current prior art.

SUMMARY OF THE INVENTION

It is therefore the object of the present invention to improve upon the current prior art. The present invention is a cup with an integrated blender system that is manually operated to stir contents within the cup. The lid of the blender cup features an oval handle fused to a freely rotating ring gear that is held in between top and bottom cap through snap mechanism.

Rotating ring gear projects teeth inside. The oval turn handle is manually operated to rotate the ring gear which rotates planetary gears and thereby sun gear which are suspended on bottom cap through shafts and central housing respectively. Stirrer is snapped into the sun gear. The interaction between the gear systems generates a compound ratio for the stirrer so rotation of ring gears by one time will result in multiple rotation of stirrer and there by stirring content within cup evenly. The stirrer has multiple side arms and a square window shaped paddle at bottom. The stirrer is removable from the cup and may be, replaced by alternative devices such as a frother, ribbon shaped stirrer or stirrer with sharp steel blades. The present invention is designed in a manner such that the blender cup may be quickly disassembled for cleaning or swapping individual components of the cup by taking advantage of removable snap mechanism.

DETAIL DESCRIPTIONS OF THE INVENTION

Figure 1:
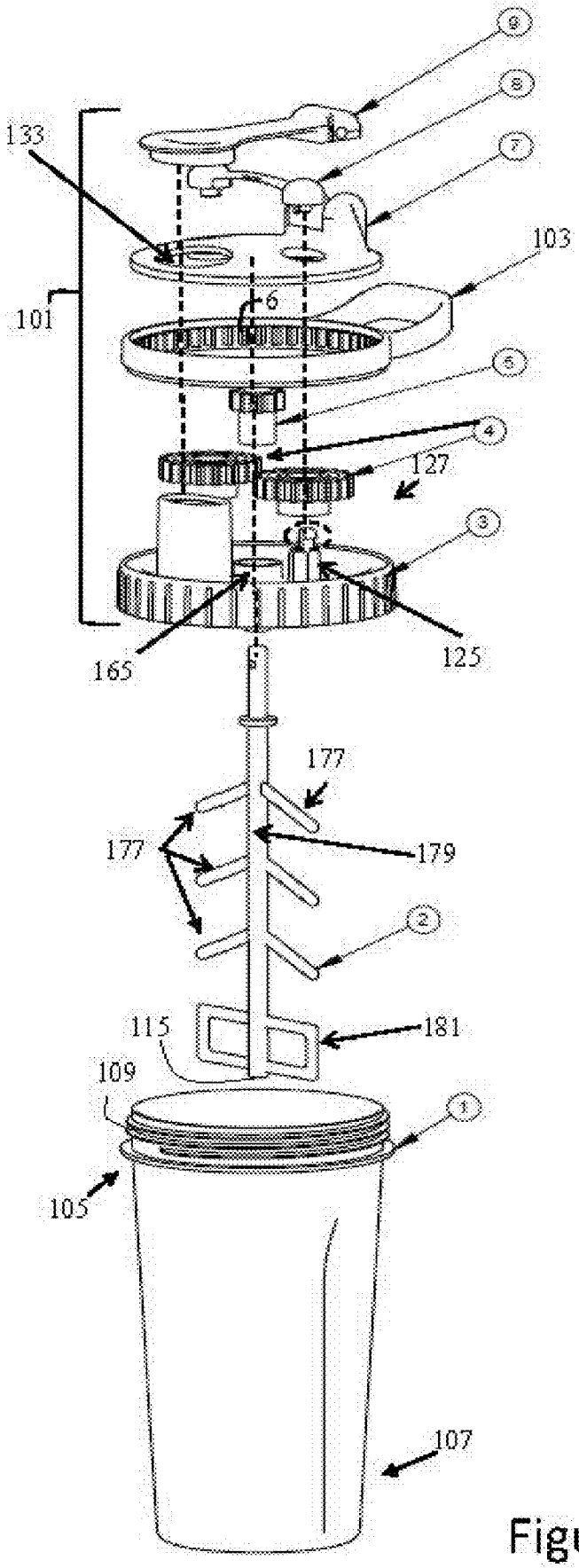
FIG. 1 is a the complete breakdown of every single part of present invention.
Figure 2:
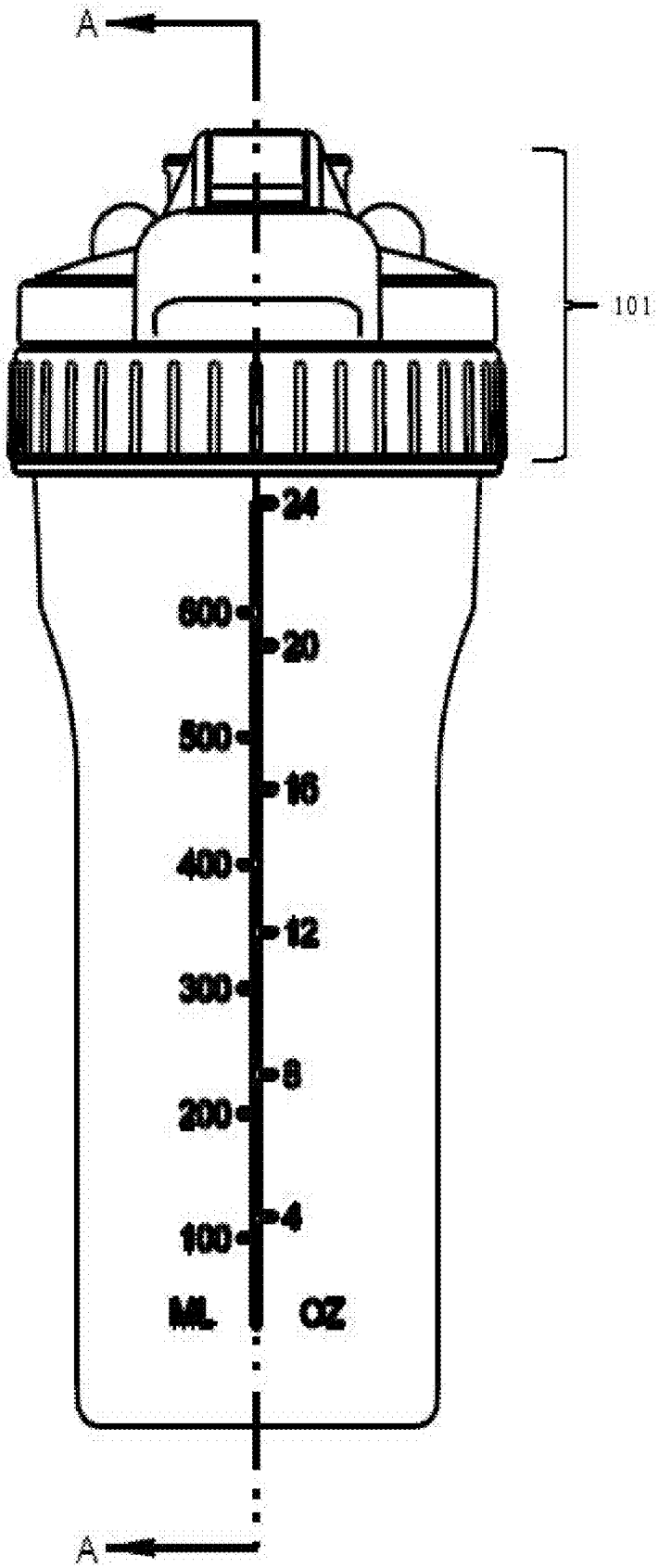
FIG. 2 is the front view of present invention

All illustrations of the drawings are for the purpose of describing selected versions of the present invention and are not intended to limit the scope of the present invention.

The present invention is a cup that contains an integrated blender system within the cup. In its preferred embodiment, the present invention comprises a lid 101, cup body 1 and stirrer 2. The lid 101 holds blending mechanism which comprise of snap shaft cap 8, top cap 7, bottom cap 3, a ring gear 6 with fused oval handle 103 on outer surface, two planetary gears 4 and one sun gear 5. The present invention may be quickly disassembled into its individual components for cleaning or swapping of the components.

Figure 3:
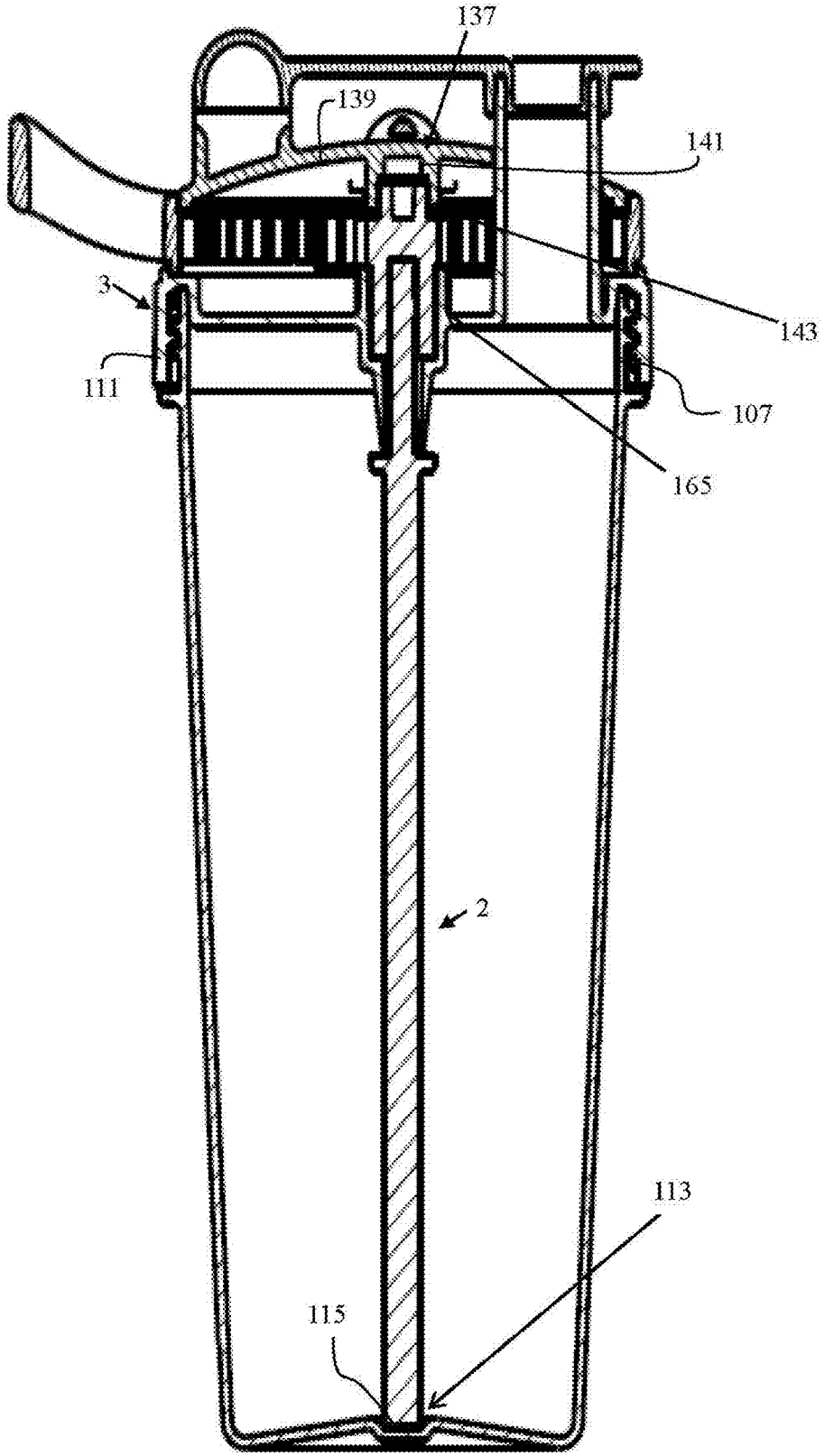
FIG. 3 is cross sectional view of blender cup which shows internal mechanism of cap and stirrer
Figure 4:
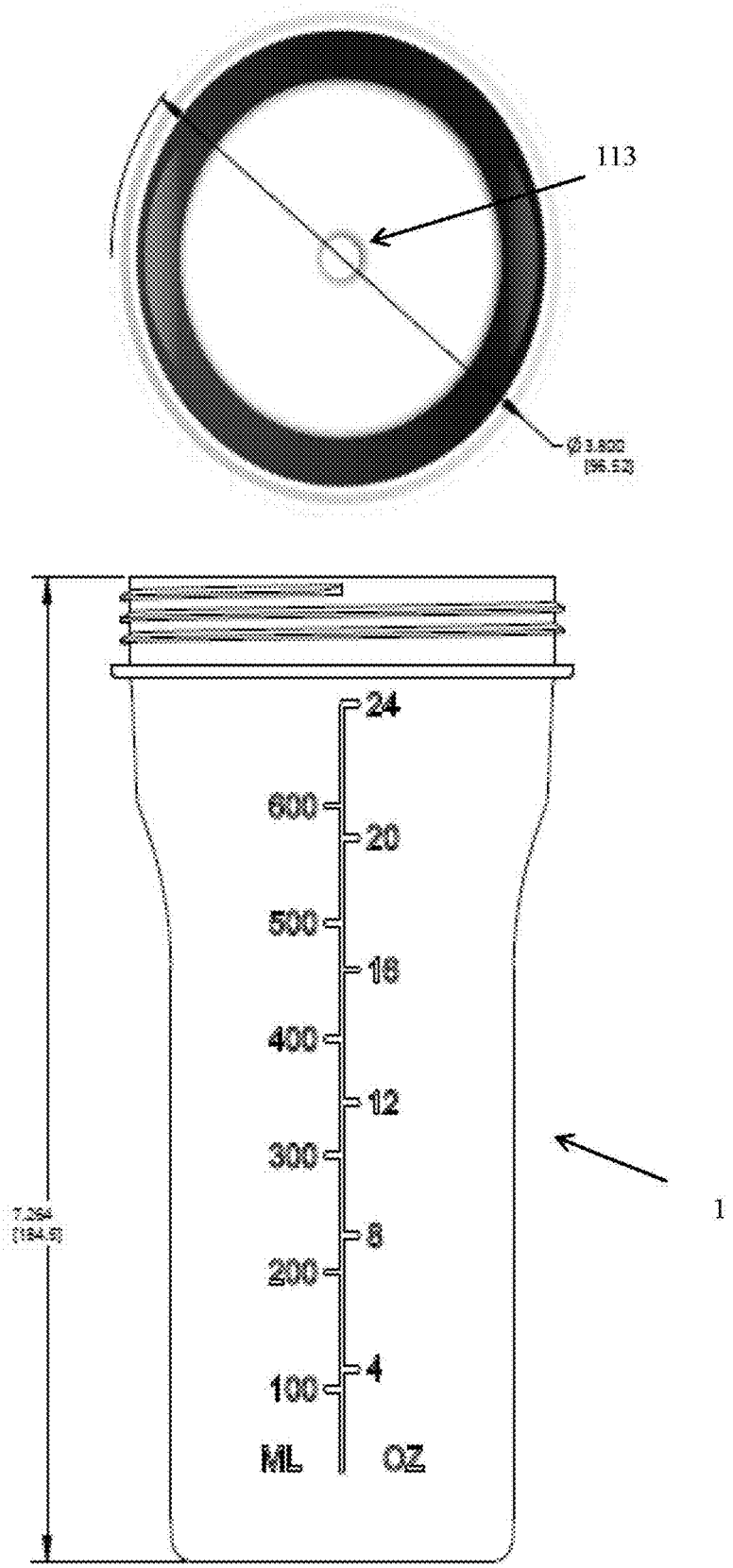
FIG. 4 is a drawing of bottom of the cup with circular depression and complete cup body with side depression and marking of gm./ml.

The diameter of the first end 105 of the cup body 1 is larger than that of the second end 107 of the cup body 1. Top end 105 of cup body 1 has threading 109 which corresponds to threading 107 of lip 111 of bottom cap 3 of the lid 101. Cup body 1 can be easily screwed into the lid 101. Moreover, this threading is designed in such a way that it can provide better protection from leaking while blending. The tapered cylindrical extrusion of material is hollow with the first end of the cup body 1 open to the exterior and the second end of the cup body 1 closed. At the bottom of cup body 1 there is a small circular depression 113 (FIG. 3) which provided housing for bottom end 115 of stirrer 2. This housing 113 is designed to keep stirrer 2 in the center while rotating.

The lid 101 comprises of five main parts snap shaft cap 8, top cap 7, spout cap 9, bottom cap 3 with, gears 4 and 5 and freely moving ring gear 6 with fused oval handle 103 at outer surface.

Figure 5:
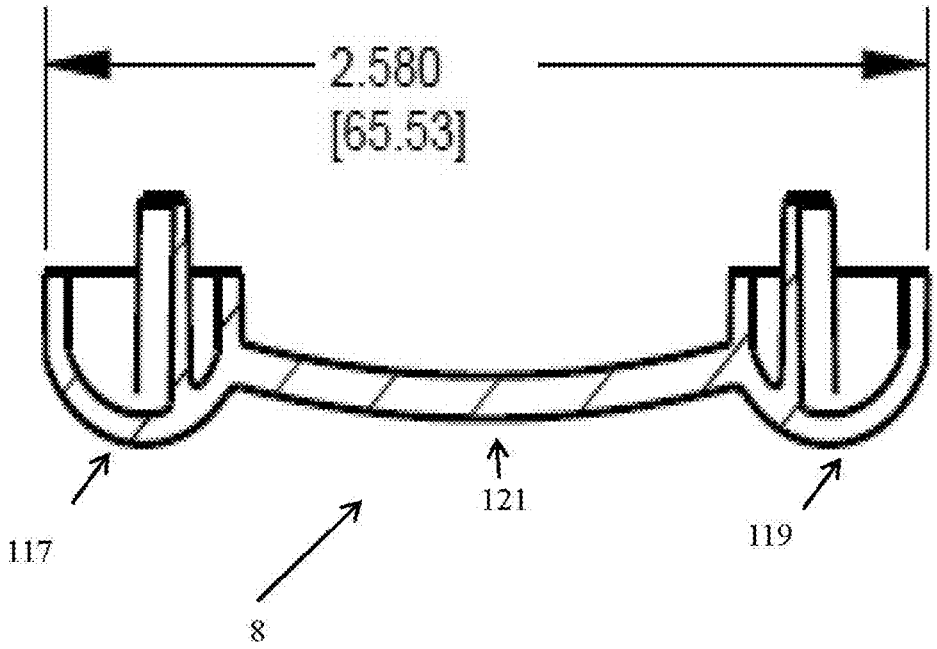
FIG. 5 is a cross-sectional view of snap shaft cap which shows two domes attached with plastic cane.

Snap Shaft cap 8 (FIG. 5) is made of two dome shaped cap 117 and 119 which is fused through a plastic cane 121. The main purpose of this snap shaft cap 8 is to lid snap mechanism generally referenced as 127) and prevent powder or liquid to pour into shafts 123 and 125 of bottom cap 3. The dome 117 and 119 present at each end of snap shaft cap 8 fills the space left over by snap shaft 123 and 125 of bottom cap 3. The Snap shaft cap 8 is essentially another snap mechanism 127 that provides more support to snap mechanism between top cap 7 and bottom cap 3.

Figure 6:
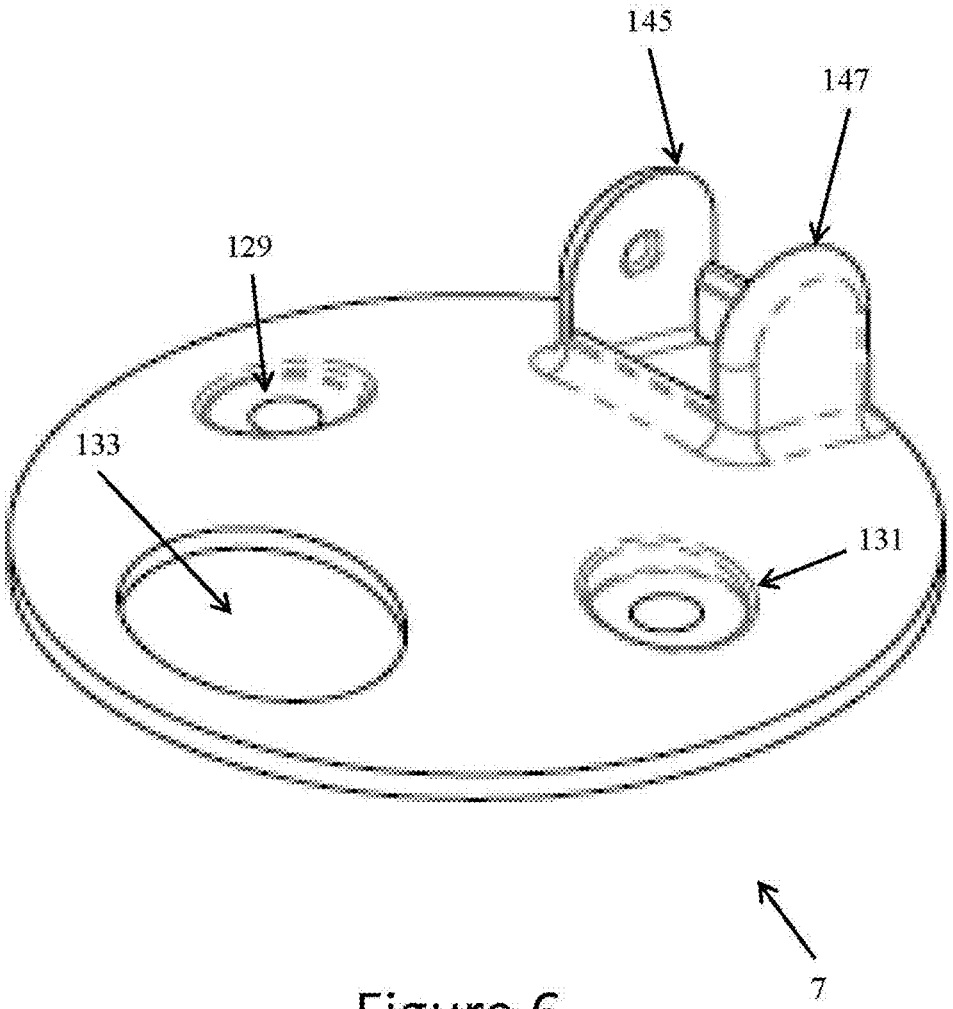
FIG. 6 is the front view of top cap which shows two circular openings for snap shafts, of bottom cap and also opening for spout.
Figure 7:
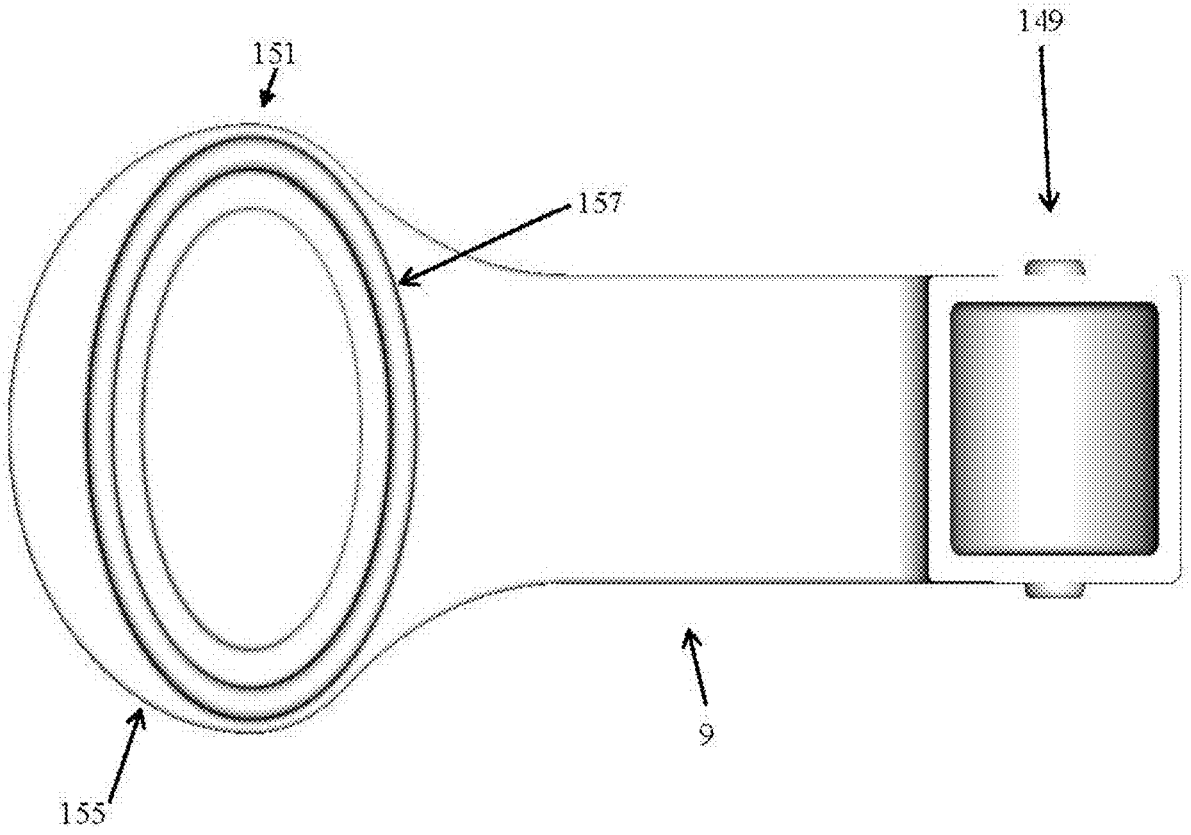
FIG. 7 is the side view of spout cap which shows dome and ring surrounded to it.

Top cap 7 (FIG. 6) is very carefully designed dome which snaps onto shafts 123 and 125 of bottom cap 3 and sits on ring gear 6 without providing much resistance. Top cap 7 has three opening, two circular openings 129 and 131 correspond to shafts 123 and 125 of bottom cap 3 and one oval opening 133 on the side which provides spout 135 to go through. In the center 137 of the interior side 139 of the top cap 7 has circular housing 141 (FIG. 3) which provides housing for the top end 143 of sun gear 5. Top cap 7 outer surface has a collar with two walls 145 and 147 facing opposite site to hold spout cap 9. One end 149 of spout cap 9 (FIG. 7) is designed in such a way that it snaps in between two walls 145 and 147 on the surface of top cap 7 which is supported by collars on the side. This provides free movement to spout cap 9. On another end 151 of spout cap 9 has circular dome 155 same size as spout opening 153. This dome 155 snaps into spout opening 153 and prevents liquid from leaking. In order to provide more protection from leaking dome 155 is also covered with protective circular ring 157 which sits on outer surface of spout opening 153 while dome 155 snapped in spout opening 153.

Figure 8:
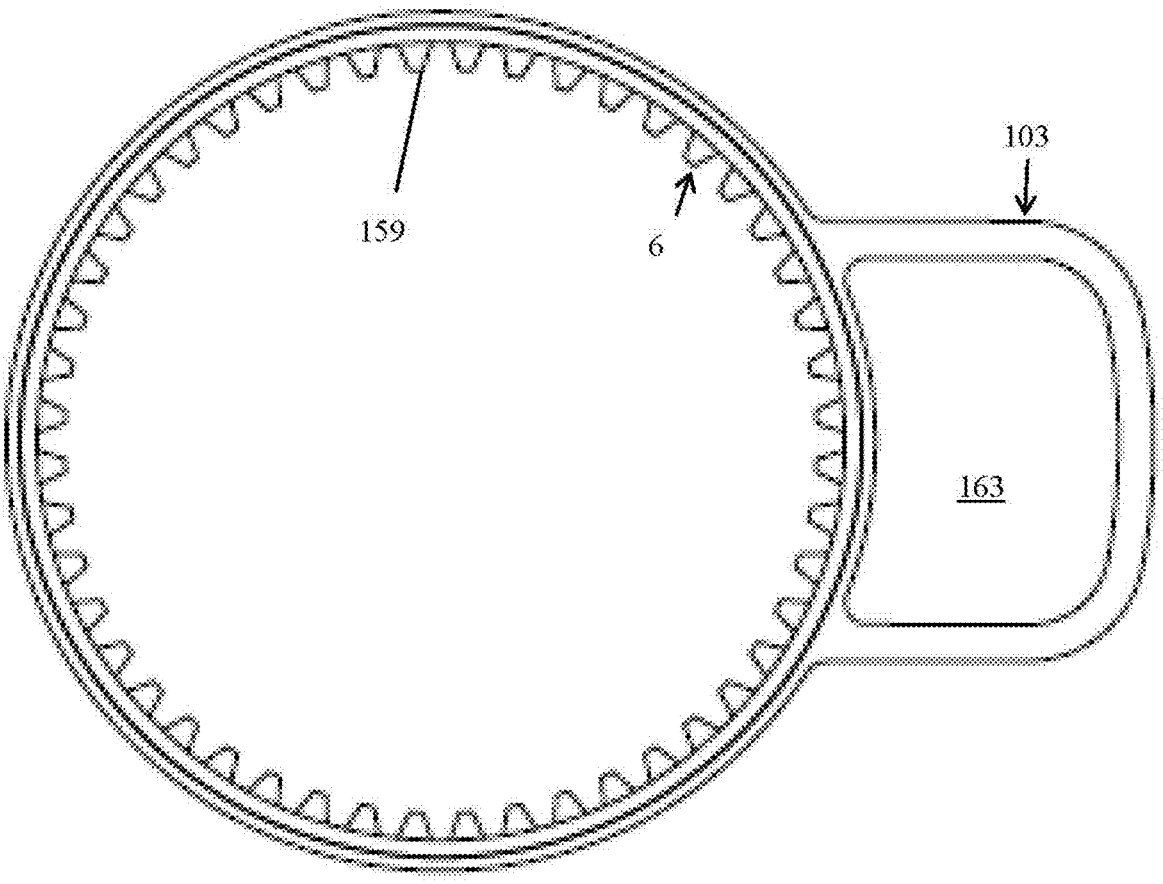
FIG. 8 is the top view of ring gear fused with oval handle which shows several teeth projecting inside and oval turn handle
Figure 9:
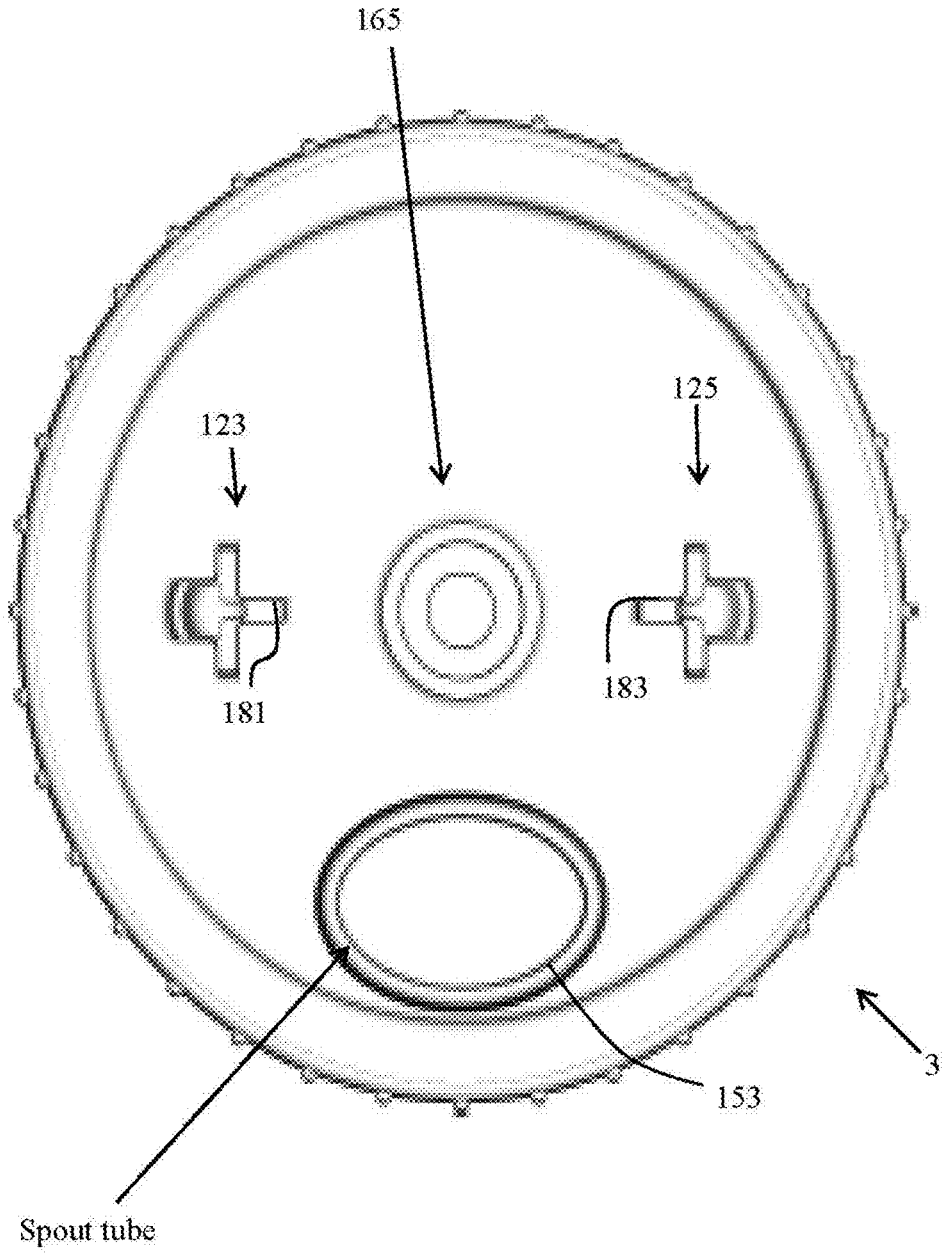
FIG. 9 is the top view of bottom cap which shows two snap shaft housing for sun gear, spout tube, central circular housing and surrounding ridges for better grip
Figure 10:
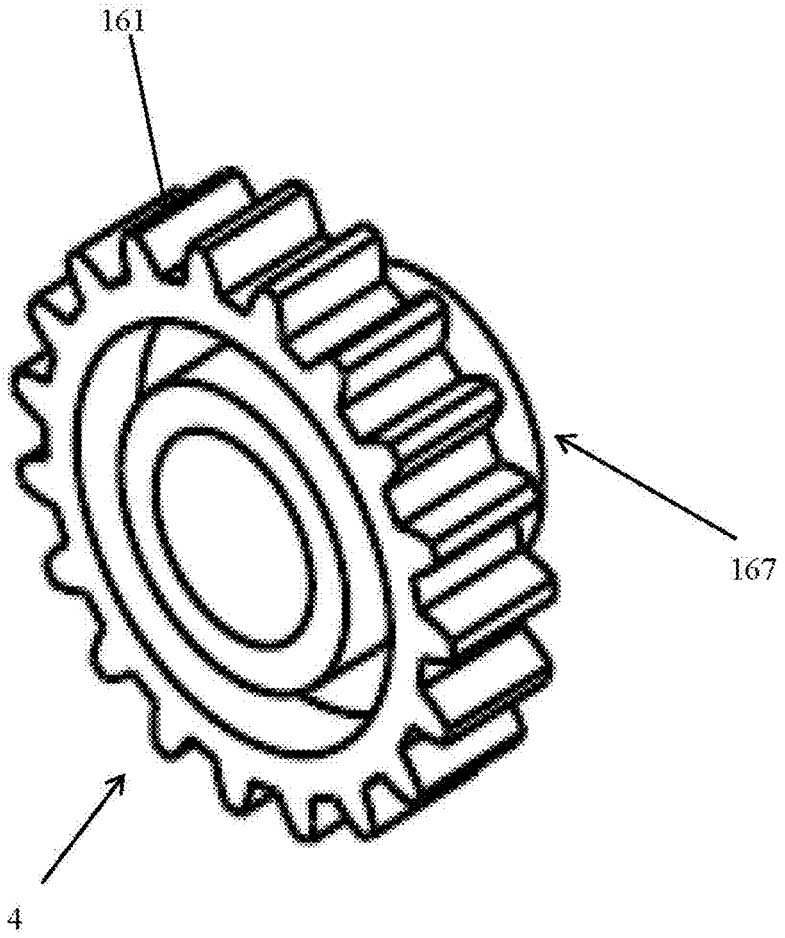
FIG. 10 is the side view of planetary gear showing teeth and shaft.

The lid 101 also comprise of ring gear 6 (FIG. 8) fused with oval handle 103. This ring gear 8 has teeth 159 projected inwards and remains engaged with teeth 161 of planetary gears 4 of bottom cap 3. Oval handle is fused to outer surface in such way that it provides maximum torque to planet gears 4. Oval handle 103 has enough space 163 as it can be operated by hand or index finger. Bottom cap 3 (FIG. 9) has two snap shafts 123 and 125 and central housing 165 for sun gear 5. Shafts 123 and 125 are designed in a way that they snap in and out comfortably to top cap 7 without providing much resistance to ring gear 6 in the middle. Planetary gears 4 (FIG. 10) comprise tapered cylindrical extrusion of material with a plurality of ridges forming gear teeth 161 along the outer surface of the gear 4 and cylindrical shaft 167 at bottom. The planetary gears 4 are designed in a manner such that they rotate freely on solid snap shafts 123 and 125 and remain engaged with sun gear 5 and ring gear 6.

Figure 11:
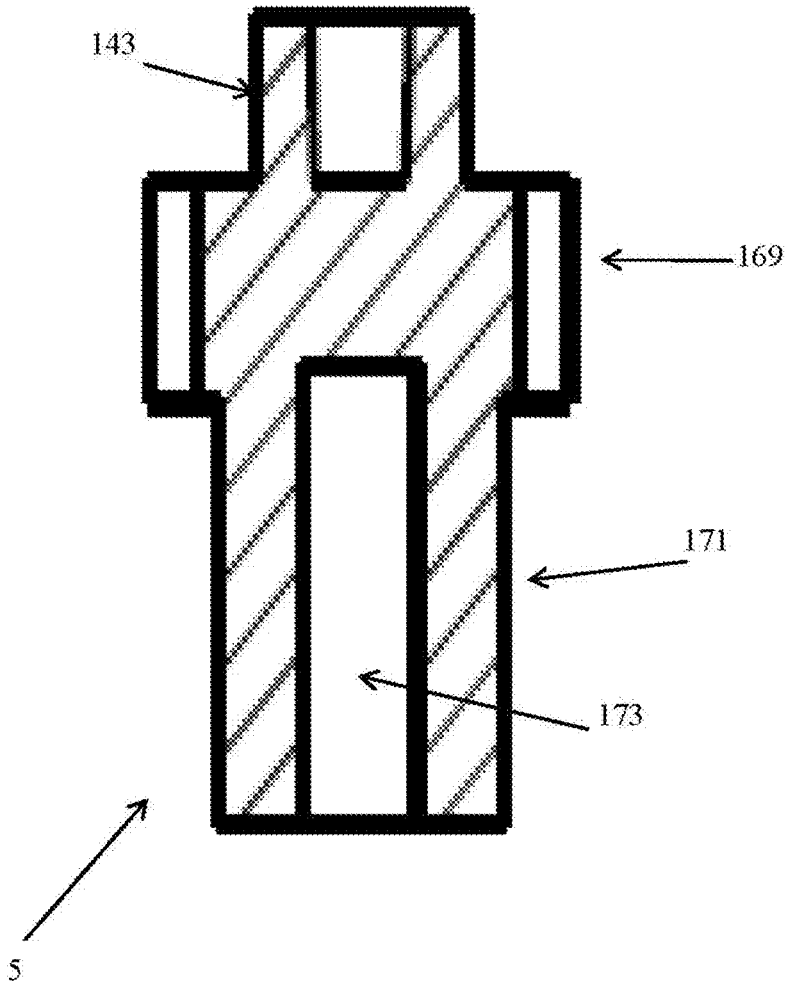
FIG. 11 is cross-section view of sun gear which shows square housing at bottom shaft and cylindrical projection on top which stays in circular housing of top cap to keep stirrer in central position.

Sun gear 5 (FIG. 11) comprises a tapered cylindrical extrusion of material with a plurality of ridges forming gear teeth 169 along the outer surface of the sun gear 5, cylindrical shaft 171 at bottom and lesser diameter cylindrical shaft 143 on top. Top shaft 143 of sun gear 5 remains in position while freely rotating on base of bottom cap 3 of housing 141 using circular housing 141 (FIG. 3) of a top cap 7. Sun gear shaft 171 is, hollow and has a square housing 173 which is designed to attach to a top end 175 of stirrer 2. Thereby when stirrer 2 is attached to sun gear 5 through square housing 173, it converts 1 rotation of outer ring gear 6 to five rotation of stirrer 2 through compound ratio.

Figure 12:
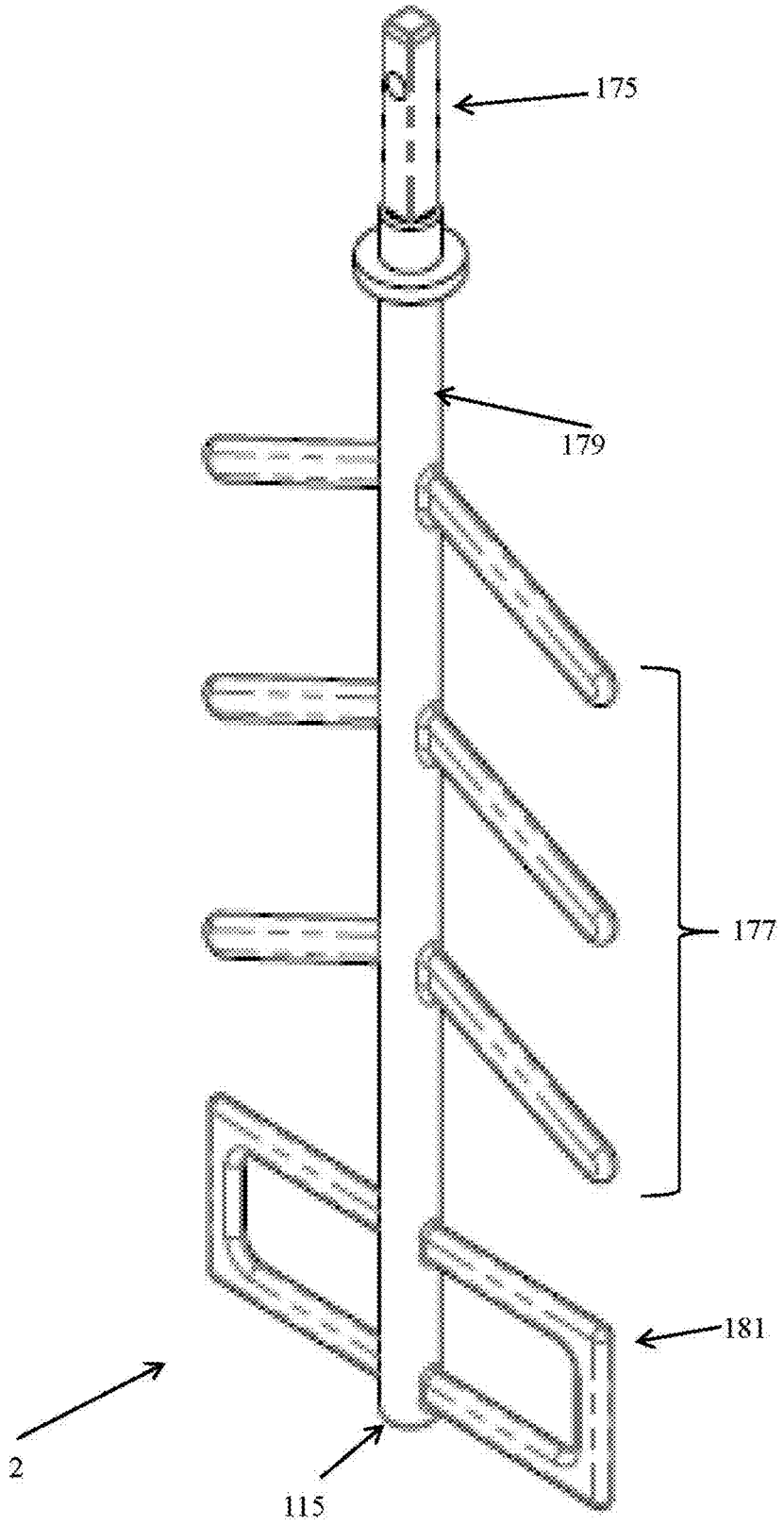
FIG. 12 is the side view of stirrer with side arms and window shaped paddle at bottom

The present invention further comprises a stirrer device 2 (FIG. 12). In the preferred embodiment of the present invention, the Stirrer device 2 consist of three pairs of side arms 177 parallel to each other fused on a central shaft 179 and window shaped paddle 181 at bottom. The side arms 177 create a vortex and mix liquid with powder while window paddle 181 at bottom scoops up the powder in upward direction without allowing powder to form lump. This way the powder is distributed thoroughly and at same time lumps are broken and blended smoothly. The stirrer device 2 is held in place within the cup body 1 by snapping in one end 175 in sun gear 5 and another end 115 resting in bottom housing 113 of cup body 1. Overall, this uniquely designed stirrer 2 scoops up the powder from bottom and mixes powder in a strong liquid vortex. However, the present invention is not limited with respect to shape and size of the stirrer device 2 and alternative embodiments of the present invention may feature varying designs.

Before using the present invention, nutritional supplements are placed into the cup body 1 along with the base liquid to be consumed. Stirrer 2 is attached or screwed into sun gear 5 of the lid 101, placing the stirrer 2 in contacts with sun gear 5. The lid 101 is then screwed onto the cup body 1, Rotating ring gear 6 by oval handle 103 using finger rotates the ring gear 6 and causes the planet gears 4 to rotate sun gear 5. As sun gear 5 is far smaller it rotates faster than ring gears 6 and planet gears 4. The rotation of the ring gear 6 causes the planet gears 4 to rotate and thereby causing rotation of sun gear 5 and stirrer device 2. As the stirrer device 2 rotates, the contents within the cup body 1 are stirred and mixed together. The user may continue rotating ring gear 6 until he or she is satisfied with the nutritional beverage. To remove or replace the stirrer device 2, a user is only required to unscrew the lid.

In case of assembly, planetary gears 4 are placed over shafts 123 and 125, and sun gear 5 placed in central housing 165 of bottom cap 3. Ring gear 6 is placed on the top of bottom cap 3, and top cap 7 is simply snapped on bottom cap 3. The domes 117 and 119 of snap shaft cap 8 are pressed onto top end 181 and 183 of snap shafts 123 and 125. Once the lid 101 is ready, stirrer 2 is simply snapped in and the lid 101 is screwed onto cup body 1.

In order to do major cleaning of blender cup, the lid 101 is required to be unscrewed and stirrer 2 needs to snap out. Snap shaft cap 8 needs to be pulled out using leverage through plastic cane 121 which exposes top end 181 and 183 of snap shafts 123 and 125 of bottom cap 3. As pressure is applied to snap shafts 123 and 125, fingers may be used to pull up oval handle 103, which would detach top cap 7 from bottom cap 3. Once disassembled, the consumer can simply throw parts into dishwasher for cleaning or can use brush to clean if require. Total assembly or disassembly requires less than a minute.

An alternative embodiment of the present invention features a frother device in place of the stirrer device 2. The frother device is operated in the same manner as that of the blender device.

Although the present invention has been explained in relation to its preferred embodiment, it is to be understood that many other possible modifications and variations can be made without departing from the spirit and scope of the present invention.

The invention claimed is:

1. A manually operated blender, comprising:

a lid with fully detachable components for cleaning which houses a detachable reverse planetary gear system;

the lid includes:

a stationary top cap having a spout opening;

a stationary bottom cap with an integral spout that extends out of the spout opening of the stationary top cap, with the stationary bottom cap detachably coupled with a cup body; and a movable handle that is an integral part of a rounded body, forming a single piece unit;

the rounded body has an annular configuration, an inner circumference of which is comprised of a ring gear;

the rounded body with the associated ring gear is detachably positioned between the stationary top cap and the stationary bottom cap;

the handle is connected to an exterior circumference of the rounded body by two connection portions of the handle that extend a distance transverse a longitudinal axis of the blender, defining a handle opening with a plane that is oriented transverse the longitudinal axis of the blender, with the opening adapted for insertion of one or more fingers of a hand and for facilitating added torque;

the reverse planetary gear system in between the stationary top cap and the stationary bottom cap further includes:

two planetary gears; and a sun gear;

the ring gear rotates around the two planetary gears that rotate on shafts that are integral with the stationary bottom cap as the handle is moved;

the sun gear is associated with a central housing that is integral with the stationary bottom cap;

the sun gear is positioned between the two planetary gears;

the two planetary gears simultaneously engage the ring gear at first ends of the two planetary gears and the sun gear at second ends, opposite the first ends of the two planetary gears;

center axes of the ring gear, the two planetary gears, and the sun gear are parallel;

centers of the two planetary gears and the sun gear are aligned and in series within the ring gear;

centers of the sun gear and the ring gear are concentric;

a stirrer is detachably connected with the sun gear;

the stirrer is comprised of pairs of side arms connected to a central shaft and a window paddle at bottom;

wherein: a movement of the movable handle moves the ring gear, which is meshed with the first ends of the two planetary gears to rotate the two planetary gears, with the second opposite ends of the two planetary gears meshed with the sun gear, which rotate the sun gear at a compound gear ratio for a desired rotational speed of the stirrer.

2. A manually operated blender, comprising:

a cup body having a longitudinal axis;

a lid that detachably secures onto the cup body; and a stirrer positioned within the cup body, and coupled with the lid;

the lid is comprised of detachable components for cleaning, including:

a stationary top cap having a spout opening;

a stationary bottom cap with an integral spout that extends out of the spout opening of the stationary top cap, with the stationary bottom cap detachably coupled with the cup body; and a moveable, handle that is associated with a reverse planetary gear system detachably positioned in between the stationary top cap and the stationary bottom cap, with the movable handle extending a distance away from cup body, transverse the longitudinal axis of the cup body, facilitating added torque;

the movable handle includes a sufficient size opening with a plane that is oriented transverse the longitudinal axis of the blender, with the opening adapted for insertion of one or more fingers of a hand;

wherein: an application of force to the moveable handle translates into an in-plane rotational torque force applied to the moveable handle to rotate the moveable handle;

the rotation of the moveable handle generates a compound gear ratio for a desired rotational speed of the stirrer via the reverse planetary gear system;

the reverse planetary gear system is comprised of:

a ring gear as part of an inner circumference of an annular rounded body, with an opening through which the integral spout of the stationary bottom cap passes to extend out of the spout opening of the stationary top cap, with the handle fixed to and an integral part of the rounded body; and two planetary gears; and a sun gear with a center concentric with the ring gear;

the sun gear is positioned between the two planetary gears;

center axes of the ring gear, the two planetary gears, and the sun gear are parallel;

centers of the two planetary gears and the sun gear are aligned and in series within the ring gear.

3. The manually operated blender as set forth in claim 2, wherein:

the two planetary gears are comprised of:

a tapered cylindrical extrusion with a plurality of ridges forming gear teeth along an outer surface thereof, and a cylindrical shaft at a bottom.

4. The manually operated blender as set forth in claim 2, wherein:

the sun gear includes:

a tapered cylindrical extrusion with a plurality of ridges forming gear teeth along the outer surface thereof a cylindrical, shaft at a bottom and a lesser diameter cylindrical shaft on a top.

5. A manually operated blender, comprising:

a cup body;

a lid with a handle that detachably secures onto the cup body; and the handle is fixed to and is an integral part of a rounded body;

the rounded body has an annular configuration with an opening transverse a longitudinal axis of the cup body, an inner circumference of the annular rounded body is comprised of a ring gear;

the handle extends a distance away from the rounded body, extending transverse the longitudinal axis of the cup body, the distance of the handle facilitating added torque;

the handle includes a sufficient size opening with a plane that is oriented transverse the longitudinal axis of the blender, with the opening, adapted for insertion of one or more fingers; and a removable stirrer positioned within the cup body, and detachably coupled with the lid;

the lid is comprised of detachable components including:

a stationary top cap having a spout opening;

a stationary bottom cap with an integral spout that extends out of the spout opening of the stationary top cap, with the stationary bottom cap detachably coupled with the cup body, with the rounded body detachably positioned in between the stationary bottom cap and the stationary top cap; and a detachable reverse planetary gear system that is disassembled for cleaning that includes:

the ring gear that revolves to drive a first planetary gear and a second planetary gear; and a sun gear positioned in between the first planetary gear and the second planetary gear;

the sun gear is driven by the first planetary gear and the second planetary gear, an output of which rotates the stirrer at a compound gear ratio;

the sun gear is concentric with the ring gear;

center axes of the ring gear, the two planetary gears, and the sun gear are parallel;

centers of the two planetary gears and the sun gear are aligned and in series within the ring gear.

6. The manually operated blender as set forth in claim wherein: the bottom cap of the lid includes:

a first shaft, a second shaft, and a central housing.

7. The manually operated blender as set forth in claim wherein: the bottom cap of the lid includes:

a first and a second shafts for mounting respective first planetary gear and second planetary gear; and a central housing for accommodating the sun gear.

8. The manually operated blender as set forth in claim 5, wherein: the bottom cap of the lid includes:

a first shaft, a second shaft, and a central housing, center axes of the first shaft, the second shaft, and the central housing are parallel;

centers of the first shaft, the second shaft, and the central housing are aligned and in series within the ring gear.

9. The manually operated blender as set forth in claim 5, wherein: the bottom cap of the lid includes:

a first shaft and a second shaft, with the first planetary gear and the second planetary gear freely rotating in place while mounted on the respective first and second shafts; and a central housing, with the sun gear freely rotating in, place while associated with the central housing.

10. The manually operated blender as set forth in claim 5, wherein: the bottom cap of the lid includes:

a first shaft, a second shaft, and a central housing protruding from a top side base of the bottom cap.

11. The manually operated blender as set forth in claim 5, wherein:

an application of force to the moveable handle translates into an in-plane rotational torque applied to the moveable handle to rotate the moveable handle;

the rotation of the moveable handle generates a compound gear ratio for a desired rotational speed of the stirrer via the reverse planetary gear system.

12. The manually operated blender as set forth in claim 5, wherein:

the top cap further includes:

a first and a second openings for accommodating, a first and a second shafts of the bottom cap.

13. The manually operated blender as set forth in claim 5, wherein:

the lid is further comprised of a snap shaft cap, which detachably covers over a first and a second openings of a top cap.

14. The manually operated blender as set forth in claim 5, wherein:

the lid is further comprised of a spout cap, which detachably covers over the spout tube.

15. The manually operated blender as set forth in claim 5, wherein:

the removable stirrer is comprised of:

a single stirrer shaft;

a plurality of equally distanced side arm pairs adjacently extending from the stirrer shaft at opposite sides of the shaft for generating a downward mixed fluid vortex; and a window paddle at a bottom end of the stirrer shaft for scooping and moving powder upwards.

* * * * *